US007429441B2

(12) United States Patent
Arthur et al.

(10) Patent No.: US 7,429,441 B2
(45) Date of Patent: Sep. 30, 2008

(54) ELECTROSTATIC CHARGE DEVELOPING TONER

(75) Inventors: Kevin A. Arthur, Westchester, OH (US); George H. Robertson, Loveland, OH (US); Seiji Funakura, Narita (JP)

(73) Assignee: Sun Chemical Corporation, Fort Lee, NJ (US)

( * ) Notice: Subject to any disclaimer, the term of this patent is extended or adjusted under 35 U.S.C. 154(b) by 0 days.

(21) Appl. No.: 10/415,169

(22) PCT Filed: Oct. 24, 2001

(86) PCT No.: PCT/IB01/02866

§ 371 (c)(1),
(2), (4) Date: May 17, 2004

(65) Prior Publication Data

US 2004/0185362 A1 Sep. 23, 2004

(51) Int. Cl.
*G03G 9/09* (2006.01)

(52) U.S. Cl. ..... 430/108.21

(58) Field of Classification Search ..... 430/108.21
See application file for complete search history.

(56) References Cited

U.S. PATENT DOCUMENTS 3,998,747 A 12/1976 Yamakami et al. ..... 252/62.1 R
4,104,276 A * 8/1978 Kranz et al. ..... 540/134
4,785,190 A * 11/1988 Frankena ..... 540/144
4,980,258 A 12/1990 Aoki et al.
5,262,264 A 11/1993 Shimizu et al.
5,554,471 A 9/1996 Bertrand et al. ..... 430/45
6,022,661 A * 2/2000 Kurose et al. ..... 430/108.7

FOREIGN PATENT DOCUMENTS

JP 60-133065 A * 7/1985

OTHER PUBLICATIONS

Derwent abstract Acc. No. C 87-352237 describing JP 62-255956 (pub. Nov. 1987).*
Derwent abstract describing JP 56-57042 (pub. May 1981).*
Derwent abstract AN 1985-207835 describing JP 60-133065 A (pub. Jul. 1985).*
Derwent abstract AN 1998-114899 describing JP 10-01619 A (pub. Jan. 1998).*
Japanese Patent Office English-language abstract describing JP 60-133065 A (pub. Jul. 1985).*
USPTO English-language translation of Japanese Patent 60-133065 (pub. Jul. 1985).*

* cited by examiner

*Primary Examiner*—Janis L Dote
(74) *Attorney, Agent, or Firm*—Dickstein, Shapiro, LLP.

(57) ABSTRACT

The present invention provides an electrostatic charge developing toner which uses a β-type copper phthalocyanine pigment that has a BET specific surface area of 90 $m^2/g$ or greater as determined by the nitrogen adsorption method.

8 Claims, No Drawings

ELECTROSTATIC CHARGE DEVELOPING TONER

FIELD OF THE INVENTION

The present invention relates to an electrostatic charge developing toner used to develop electrostatic charge images in electro-photography, electrostatic recording or electrostatic printing, etc.

BACKGROUND OF THE INVENTION

The electro-photographic method is ordinarily a method in which an electrostatic latent image carrier consisting of a photo-conductive light-sensitive material is charged, an electrostatic latent image is formed by exposure to light, this electrostatic latent image is then developed by means of a toner composition in which a coloring agent is contained in a bonding resin, and the toner image thus obtained is then transferred to a support such as a transfer paper and fixed so that a visible image is formed. Generally, toner compositions in which a black coloring agent such as carbon black is dispersed in a bonding resin are widely used as toner compositions for obtaining such visible images. In recent years, however, methods in which color images are formed by successively repeating development using colored toners such as cyan, magenta and yellow toners, transferring [the resulting toner image] onto paper and fixing this image have also been used.

In the cases of color transfer images obtained by such methods, images that are close to natural colors are generally required. Accordingly, the vividness, transparency, luster and gradation characteristics of the colors in the respective monochromatic toners have an effect. Color reproducibility is obtained by subtraction color mixing using toners of the three basic colors of yellow, magenta and cyan, and it is necessary to use transparent toners that transmit light. In the case of images in which transparent films are fixed as well, color reproducibility is impossible unless the transparency is good.

Conventionally, copper phthalocyanine pigments (U.S. Pat. No. 3,998,747), copper phthalocyaninesulfonic acid derivatives (Japanese Patent Application Kokai No. S56-57042), β-type copper phthalocyanine pigments (Japanese Patent Application Kokai No. S62-255956), and copper phthalocyanine phthalimide methyl derivatives (Japanese Patent No. H2-135459), etc., have been known as coloring agents used for cyan in electrostatic charge developing toners. Furthermore, a method in which fine particles of silicon oxide are added to organic pigments in order to improve the transparency of the toner is also known (Japanese Patent Application Kokai No. H11-7157).

However, cyan toners of the above-mentioned prior art have an insufficient transparency in terms of requirements that have arisen in recent years, and color reproducibility sufficient for use in full color applications cannot be obtained in the case of such toners.

Furthermore, cyan toners of the above-mentioned prior art are used in mixtures with carrier particles such as ferrites, etc. As a result, the balance with the carrier particles breaks down in the developing process so that differences in the shade of the color are generated; as a result, there are problems in color reproducibility in full color applications.

The object of the present invention is to provide an electrostatic charge developing toner with superior color reproducibility [i] which has sufficient transparency for use as a cyan developing agent, and [ii] which exhibits a vivid green color in the case of superimposition with a yellow developing agent, a vivid blue color in the case of superimposition with a magenta developing agent, and a vivid black color in the case of superimposition with yellow and magenta developing agents.

In light of the above facts, the present inventors conducted diligent research in order to eliminate the drawbacks of the prior art. As a result of this research, the inventors succeeded in perfecting the present invention. Specifically, to solve the above-mentioned problems, the present invention provides an electrostatic charge developing toner which is characterized by the fact that in an electrostatic charge developing toner which uses a bonding resin and a coloring agent as essential components, a β-type copper phthalocyanine pigment which has a BET specific surface area of 90 $m^2/g$ or greater is used as the coloring agent.

SUMMARY OF THE INVENTION

The present invention will be described in detail below.

The β-type copper phthalocyanine pigment used in the present invention is characterized by the fact that this pigment has a BET specific surface area of 90 $m^2/g$ or greater.

The BET specific surface area used in the present invention is measured according to the method stipulated in Appendix 2 of Japanese Industrial Standard (JIS) Z 8830-1990 (Methods for Measuring the Specific Surface Area of Powders by Gas Adsorption).

In one electrostatic charge developing toner, the amount of the phthalocyanine pigment derivative is 0.01 to 0.3 parts by weight per 1 part by weight of the β-type phthalocyanine pigment.

In conventional β-type copper phthalocyanine pigments, the BET specific surface area is smaller than the above-mentioned value. In the case of such pigments, it is difficult to obtain a blue color that is superior in terms of transparency, regardless of the field of use. The pigment of the present invention solves this drawback as a result of the above-mentioned constitution. It is sufficient if the β-type copper phthalocyanine pigment used in the present invention has a BET specific surface area of 90 $m^2/g$; however, this specific surface area is preferably 90 to 200 $m^2/g$, and is even more preferably 90 to 150 $m^2/g$.

For example, the β-type copper phthalocyanine pigment of the present invention can be manufactured by subjecting a β-type copper phthalocyanine crude or β-type copper phthalocyanine semi-crude containing an α-type copper phthalocyanine to solvent salt milling for a longer time than in a conventional process, under conditions in which the multiple of the inorganic salt relative to the crude or semi-crude is higher than in a conventional process.

The term "β-type copper phthalocyanine crude" used in the present invention refers to a β-type copper phthalocyanine in which the mean particle size of the primary particles is in the range of 0.2 to 50 μm. Furthermore, the term "β-type copper phthalocyanine semi-crude containing an α-type copper phthalocyanine" refers to a mixture of an α-type copper phthalocyanine and a β-type copper phthalocyanine in which primary particles with a mean particle size of 0.001 to 0.02 μm are aggregated.

Here, any universally known customary manufacturing method may be used as the manufacturing method of the β-type copper phthalocyanine crude.

For example, a method known as the Willer method in which a β-type copper phthalocyanine is synthesized by reacting phthalic anhydride, urea and a copper salt, or a method known as the phthalonitrile method in which a β-type copper phthalocyanine is synthesized by reacting phthalonitrile and a copper salt, may be used as the manufacturing method of such a β-type copper phthalocyanine crude. Alternatively, a method in which a β-type copper phthalocyanine is synthesized by reacting phthalic anhydride, urea and a copper salt in the presence of trimellitic acid, pyromellitic acid or a derivative of these acids such as an anhydride, imide or ester (Japanese Patent Application Kokai No. S61-203175), or a method in which a copper phthalocyanine is synthesize by using a paraffin-type hydrocarbon solvent and a naphthene-type hydrocarbon solvent in combination (Japanese Patent Application Kokai No. H8-27388), may also be used.

Examples of β-type copper phthalocyanine crudes that can be used in the present invention include "Firstogen Blue AC", "Firstogen Blue 81" and "Firstogen Blue AC-E" manufactured by Dainippon Ink And Chemicals, Incorporated.

A β-type copper phthalocyanine semi-crude containing an α-type copper phthalocyanine can be obtained by (for example) pulverizing a β-type copper phthalocyanine crude. Ordinarily, such a semi-crude is obtained by the dry pulverization of a β-type copper phthalocyanine crude in the presence of a pulverization medium.

Dry-type pulverization devices which can be used for such pulverization include ball mill devices, vibrating mill devices, attritor mill devices, cylindrical bead mill devices and horizontal double drum mill devices, etc., filled with a pulverization medium, etc. Among these devices, an attritor mill device is desirable [i] which consists of a cylindrical pulverization vessel with a vertical center line which is used to hold the powder that is to be pulverized, a rotating shaft which is installed along this center line, and an agitator which is fastened to this rotating shaft, and which has two or more pairs of arms that respectively extend symmetrically outward toward the side walls of the pulverization vessel, and [ii] which is filled with steel balls as a pulverization medium (such a device is described in Japanese Patent Application Kokai No. S58-29861).

Pulverization media which can be used in such dry pulverization devices include balls or rods, etc., consisting of iron, stainless steel, corundum, porcelain, steatite, aluminum oxide, zirconium oxide, oxide mixtures or quartz, etc. The size [of the media] is ordinarily 1 to 50 mm.

This dry pulverization is ordinarily performed at a temperature of 100° C. or lower, and is preferably performed at a temperature ranging from room temperature to 100° C. The dry pulverization time is determined by the type of pulverization device used and the required specific surface area of the pigment, but is generally 0.1 to 36 hours. For example, the dry pulverization time in a case where the above-mentioned ideal attritor mill is used as the pulverization device is ordinarily 0.1 to 10 hours, and is preferably 0.5 to 5 hours. The dry pulverization time in a case where a vibrating mill is used is ordinarily 1 to 36 hours, and is preferably 2 to 12 hours.

When a β-type copper phthalocyanine crude is pulverized, a β-type copper phthalocyanine semi-crude containing an α-type copper phthalocyanine is obtained.

Below, the [above-mentioned] β-type copper phthalocyanine crude and β-type copper phthalocyanine semi-crude containing an α-type phthalocyanine will be referred to together as crude pigments.

Crude pigments obtained in this manner are then subjected to a pigmentization treatment. There are no particular restrictions on the pigmentization treatment method used; various types of pigmentization treatment methods can be employed. However, from the standpoint of suppressing conspicuous crystal growth and obtaining pigment particles with a large specific surface area, it is more desirable to use a solvent salt milling treatment than a solvent treatment in which [the crude pigment] is heated and agitated in a large quantity of an organic solvent.

This solvent salt milling refers to a treatment in which the crude pigment, an inorganic salt and an organic solvent are kneaded and pulverized. In concrete terms, the crude pigment, an inorganic salt and an organic solvent that does not dissolve these ingredients are placed in a kneading machine, and kneading and agitation are performed in this machine. Examples of kneading machines that can be used in this case include kneaders and mix maulers, etc.

A water-soluble inorganic salt may be appropriately used as the above-mentioned inorganic salt; for example, the use of an inorganic salt such as sodium chloride, potassium chloride or sodium sulfate is desirable. Furthermore, it is more desirable to use an inorganic salt that has a mean particle size of 0.5 to 50 μm. Such inorganic salts can easily be obtained by finely pulverizing ordinary inorganic salts.

It is desirable that the amount of inorganic salt used be set at 6 to 20 parts by weight per one part by weight of the crude pigment, and an amount in the range of 8 to 15 parts by weight is even more desirable.

Water-soluble organic solvents as organic solvents that are capable of suppressing crystal growth can be appropriately used as the [above-mentioned] organic solvent. Examples of solvents that can be used include diethylene glycol, glycerol, ethylene glycol, propylene glycol, liquid polyethylene glycols, liquid polypropylene glycols, 2-(methoxymethoxy) ethanol, 2-butoxyethanol, 2-(isopentyloxy)ethanol, 2-(hexyloxy)ethanol, diethylene glycol monomethyl ether, diethylene glycol monoethyl ether, diethylene glycol monobutyl ether, triethylene glycol, triethylene glycol monomethyl ether, 1-methoxy-2-propanol, 1-ethoxy-2-propanol, dipropylene glycol, dipropylene glycol monomethyl ether, dipropylene glycol monomethyl ether [sic] and dipropylene glycol [sic], etc.

There are no particular restrictions on the amount of this water-soluble organic solvent that is used; however, it is desirable that the amount used be 0.01 to 5 parts by weight per one part by weight of the crude pigment.

In obtaining the pigment that is used in the present invention, the crude pigment alone may be subjected to solvent salt milling; however, from the standpoint of obtaining a pigment with the specific surface area stipulated in the present invention in a shorter time, it is desirable to perform solvent salt milling using a combination of the crude pigment and a phthalocyanine pigment derivative. The pigment that is obtained by performing solvent salt milling using a combination of a copper phthalocyanine and a phthalocyanine pigment derivative is a pigment that contains a β-type copper phthalocyanine pigment and a phthalocyanine pigment derivative. Furthermore, the overall pigment containing the β-type copper phthalocyanine pigment and phthalocyanine pigment derivative has a specific surface area within the above-mentioned BET specific surface area range.

In cases where pigments having the same specific surface area are obtained, performing solvent salt milling in the presence of a phthalocyanine pigment derivative makes it possible to reduce the amount of inorganic salt used, even within the range stipulated by the present invention, compared to a case where solvent salt milling is performed without such a phthalocyanine pigment derivative.

Phthalocyanine pigment derivatives that can be included in the crude pigment during solvent salt milling include all universally known customary derivatives of this type; however, phthalocyanine pigment derivatives expressed by the following general formula (I) or (II) are desirable.

$P—(Y)_n$[Chemical Formula 3] (I)

$P—(A-Z)_n$[Chemical Formula 4] (II)

In the formulae, P indicates a residue formed by removing the hydrogen of n phthalocyanine rings which either have a central metal or do not have a central metal, Y indicates a primary to tertiary amino group, carboxylic acid group, sulfonic acid group or salt of the same with a base or metal, A indicates a divalent connecting group, Z indicates a residue formed by removing at least one hydrogen atom on the nitrogen atom of a primary or secondary amino group, or a residue formed by removing at least one hydrogen atom on the nitrogen atom of a hetero-ring containing nitrogen, and n is 1 to 4.

Examples of the above mentioned central metal includes divalent to trivalent metals such as copper, cobalt, manganese and aluminum. Examples of the above-mentioned primary to secondary amino groups include monomethyl amino groups, dimethylamino groups and diethylamino groups, etc. Examples of the above-mentioned bases and metals that form salts with the above-mentioned carboxylic acid groups and sulfonic acid groups include ammonia, organic bases such a dimethylamine, diethylamine and triethylamine, and metals such as potassium, sodium, calcium, strontium and aluminum. Examples of divalent connecting groups A include divalent connecting groups such as alkylene groups with 1 to 3 carbon atoms, $—CO_2—$, $—SO_2—$ and $—SO_2NH(CH_2)_m—$ where m is 1 to 4, and examples of Z include phthalimido groups, monoalkylamino groups and dialkylamino groups, etc.

The above-mentioned metals may be used in the form of sodium hydroxide, potassium carbonate, calcium chloride, strontium chloride and aluminum sulfate, etc.

In concrete terms, phthalimidomethyl derivatives of non-metal or metal phthalocyanines, sulfonic acid derivatives of the same, N-(dialkylamino)methyl derivatives of the same and N-(dialkylaminoalkyl)sulfonic acid amide derivatives of the same are desirable. It is also desirable that amines such as primary amines, secondary amines, tertiary amines, quaternary ammonium salts or ethylenediamine be added to these phthalocyanine pigment derivatives prior to use.

The amount of phthalocyanine pigment derivative that can be included in the crude pigment during solvent salt milling is ordinarily 0.01 to 0.3 parts by weight per one part by weight of the crude pigment. For example, the fact that such a phthalocyanine pigment derivative is being used in combination with the β-type copper phthalocyanine pigment can be confirmed by mass analysis based on the mass spectrum.

The temperature during solvent salt milling is preferably 30 to 150° C.; a temperature in the range of 50 to 100° C. is more desirable, and a temperature in the range of 60 to 95° C. is especially desirable. The solvent salt milling time is preferably 5 hours to 20 hours, and is even more preferably 5 to 18 hours.

In cases where the conditions other than the solvent salt milling temperature and time are fixed, a more desirable pigment can be obtained by performing solvent salt milling at a lower temperature and for a shorter time using the above-mentioned semi-crude, e.g., for 5 to 10 hours at 60 to 95° C.

The [above-mentioned] phthalocyanine pigment derivative may also be added to a pigment obtained by subjecting only a copper phthalocyanine crude pigment to solvent salt milling; however, a pigment obtained by subjecting both a copper phthalocyanine crude pigment and a phthalocyanine pigment derivative to solvent salt milling has a more superior effect.

In regard to the above-mentioned solvent salt milling, solvent salt milling performed for 5 to 18 hours at 60 to 95° C. using 8 to 15 parts by weight of a water-soluble inorganic salt per one part by weight of the total of the water-soluble organic solvent, copper phthalocyanine crude pigment and phthalocyanine pigment derivative produces a β-type copper phthalocyanine pigment, or pigment composition containing such a pigment and a phthalocyanine pigment derivative, with a BET specific surface area of 90 $m^2$ or greater, which is most suitable for the electrostatic charge developing toner of the present invention.

Thus, a mixture containing the β-type copper phthalocyanine pigment of the present invention, an inorganic salt and an organic solvent as its chief components is obtained. A powdered β-type copper phthalocyanine pigment can be obtained by removing the organic solvent and inorganic salt from this mixture, and subjecting the solid content consisting chiefly of a β-type copper phthalocyanine pigment to washing, filtration, drying and pulverization, etc., as required. Washing may be performed using either cold water or hot water. Washing can also be repeated 1 to 5 times. In the case of the aforementioned mixture using a water-soluble inorganic salt and a water-soluble organic solvent, the organic solvent and inorganic salt can easily be removed by washing with cold water.

Drying by means of a batch system or continuous system, etc., which removes water and/or the solvent from the pigment by heating the pigment to a temperature of 80 to 120° C. by means of a heating source installed in a drier may be cited as an example of the drying that is performed following the above-mentioned filtration and washing. The drier used may generally be a box-type drier, band drier or spray drier, etc. Furthermore, the pulverization that is performed following drying is not an operation that is performed in order to increase the specific surface area or reduce the mean particle size of the primary particles, but is rather an operation that is performed in order to break up and powder the pigment when the pigment has assumed a lump form, etc., as in the case of drying using a box-type drier or band drier. For example, such pulverization can be accomplished by means of a mortar and pestle, hammer mill, disk mill, pin mill or jet mill, etc.

In this way, a powdered pigment whose chief ingredient is a β-type copper phthalocyanine pigment with a BET specific surface area of 90 $m^2/g$ or greater is obtained.

As a result of having a specified specific surface area, the β-type copper phthalocyanine pigment used in the present invention has good dispersibility in synthetic resins, etc., that are to be colored, and the transparency of the color on such synthetic resins, etc., that are to be colored is improved. In particular, a β-type copper phthalocyanine pigment which has a BET specific surface area of 110 to 150 $m^2/g$ is especially superior in this regard.

It is desirable that the β-type copper phthalocyanine pigment used in the present invention show an oil absorption of 50 to 80 ml/100 g. The oil absorption value used in the present invention is measured according to the method stipulated in JIS K 5101-1991 (Pigment Test Methods, 21. Oil Absorption).

Furthermore, in the pigment used in the present invention, the aggregating power of the primary particles is weaker than in conventional pigments, so that the pigment is more easily broken up [into primary particles]. Individual primary particles of the pigment making up aggregate bodies, which cannot be observed in the case of conventional pigments, can be observed by means of electron micrographs. In the pigment of the present invention, it is desirable from the standpoint of further improvement of the above-mentioned dispersibility that the mean particle size of the primary particles be in the range of 0.01 to 0.6 μm.

Furthermore, the mean particle size of the primary particles of the pigment and the longitudinal-lateral aspect ratio of the primary particles of the pigment can be measured by means of a transmission electron microscope or scanning electron microscope after the pigment has been ultrasonically dispersed in a solvent.

The mean particle size of the primary particles of the pigment in the present invention is a value that was obtained by imaging the pigment in the visual field of a transmission electron microscope JEM-2010 (manufactured by JEOL Ltd.), respectively determining the long diameter for 50 primary particles of the pigment forming aggregate bodies on a two-dimensional image, and averaging these values.

Furthermore, if the longitudinal-lateral aspect ratio of the β-type copper phthalocyanine pigment of the present invention is in the range of 1 to 3, this contributes to an improvement of the viscosity characteristics in various fields of application, so that the fluidity is increased.

The longitudinal-lateral aspect ratio of the primary particles of the pigment of the present invention is determined from the short diameter and the above-mentioned long diameter. The short diameter is a value determined by imaging the pigment in the visual field of a transmission electron microscope, respectively determining the short diameter for 50 primary particles of the pigment forming aggregate bodies on a two-dimensional image, and averaging these values.

If the β-type copper phthalocyanine pigment of the present invention is used in the manufacture of an electrostatic charge developing toner, a superior effect is manifested. The electrostatic charge developing toner of the present invention can be manufactured using a bonding resin and a β-type copper phthalocyanine pigment which has a BET specific surface area of 90 $m^2/g$ or greater as the essential components. Below, this electrostatic charge developing toner will be abbreviated to "toner."

When a toner is manufactured in the present invention using the above-mentioned β-type copper phthalocyanine pigment with a specified specific surface area, the aggregation of the pigment is relatively weak, so that dispersion of the pigment in the bonding resin is easy. Accordingly, an electrostatic charge developing toner in which the image transparency and charging stability required in recent years are both good can be obtained more easily.

Furthermore, such an improvement in transparency makes it possible to obtain images that are more superior in terms of vividness in cases where full-color images are formed on the recording medium by color mixing, e.g., by superimposing toners of various colors. This effect is more conspicuous in the case of transparent films than in the case of paper.

There are no particular restrictions on the amount of the β-type copper phthalocyanine pigment of the present invention that is used in the toner; however, it is desirable that the amount contained in the toner be 0.5 to 25 parts by weight per 100 parts by weight of the bonding resin component, and an amount in the range of 2 to 15 parts by weight per 100 parts by weight of the bonding resin is even more desirable from the standpoint of causing an even more conspicuous manifestation of the charging performance of the β-type copper phthalocyanine pigment itself.

In cases where the β-type copper phthalocyanine pigment of the present invention is used in an electrostatic charge developing toner, the hue is greener, and the color reproducibility is better if the condition of a longitudinal-lateral aspect ratio of 1 to 3 is satisfied; accordingly, such an aspect ratio is desirable.

In cases where the β-type copper phthalocyanine pigment of the present invention is used in an electrostatic charge developing toner, an improvement in the dispersibility and an improvement in the dispersion stability during the manufacture of the toner, and an improvement in the charging stability of the toner, can be expected if a phthalocyanine pigment derivative of the type described above is used in combination [with the β-type copper phthalocyanine pigment].

The particle size distribution of the pigment of the present invention, and the mean particle size of the pigment powder as a whole, can be measured using a Microtrack Particle Size Distribution Meter 9220 FRA Dry Type (manufactured by Nikkiso Co., Ltd.).

Furthermore, the organic pigments shown below as examples can be mixed [with the composition of] the present invention. These organic pigments may be cited as follows in accordance with the Color Index.

Examples of phthalocyanine-type compound pigments include C. I. Pigment Blue 15, 15:1, 15:2, 15:6 and 16, and C. I. Pigment Green 7 and 36, etc.

Examples of quinacridone-type compound pigments include [C.] I. Pigment Violet 19 and 42, C. I. Pigment Red 122 , 202, 206, 207 and 209, and C. I. Pigment Orange 48 and 49, etc.

Other examples of pigments include C. I. Pigment Blue 60, C. I. Pigment Yellow 24and 108, C. I. Pigment Red 168 and 177, and C. I. Pigment Orange 40, etc.

Examples of perylene-type compound pigments include C. I. Pigment Violet 29, C. I. Pigment Red 123, 149,;178 and 179, C. I. Pigment Black 31 and 32, and C. I. Pigment Orange 43, etc.

Examples of phthalone-type compound pigments include C. I. Pigment Yellow 138, etc.

Examples of dioxazine-type compound pigments include C. I. Pigment Violet 23 and 37, etc.

Examples of isoindolinone-type compound pigments include C. I. Pigment Yellow 109, 110 and 173, and C. I. Pigment Orange 61, etc.

Examples of methyne-azomethyne-type compound pigments include C. I. Pigment Yellow 139 and 185, C. I. Pigment Orange 66, and C. I. Pigment Brown 38, etc.

Examples of diketopyrrolopyrrole-type compound pigments include C. I. Pigment Red 254, 255, 264 and 272, and Orange 71 and 73, etc.

Examples of azo lake-type compound pigments include C. I. Pigment Red 48:1, 48:2, 48:3, 48:4, 48:5, 49:1, 49:2, 49:3, 50:1, 51:1, 52:1, 52:2, 53:1, 57:1, 58:2, 58:4, 60:1, 63:1, 63:2, 64:1, 200, 211, 238, 239, 240, 243, 245 and 247, C. I. Pigment Yellow 61, 62:1, 104, 133, 168, 169, 183, 190 and 191, and C. I. Pigment Orange 17, 17:1, 19 and 46, etc.

Examples of insoluble azo-type compound pigments include C. I. Pigment Yellow 1, 3, 12, 13, 14, 17, 55, 73, 74, 81, 83, 97, 130, 151, 152, 154, 156, 165, 166, 167, 170, 171, 172, 174, 175, 176 180, 181 and 188, C. I. Pigment Orange 16, 36 and 60, C. I. Pigment Red 5, 22, 31, 112, 146, 150, 171, 175, 176, 183, 185, 208 and 213, C. I. Pigment Violet 43 and 44, and C. I. Pigment Blue 25 and 26, etc.

Examples of condensed azo-type compound pigments include C. I. Pigment Yellow 93, 94, 95, 128 and 166, C. I. Pigment Orange 31, C. I. Pigment Red 144, 166, 214, 220, 221, 242, 248 and 262, and C. I. Pigment Brown 41 and 42, etc.

Natural or synthetic resins, rubbers or waxes, etc., which show adhesive properties under the application of heat or pressure can all be used as bonding resins in the present invention.

Natural resins that are useful in the present invention include balsam resins, rosin, shellac and coval, etc. These resins may also be modified by one or more resins selected from a set consisting of vinyl resins, acrylic resins, alkyd resins and phenol resins, etc. (described later).

Furthermore, examples of synthetic resins that are useful in the present invention include universally known resins such as polyvinyl chlorides, polyacetal resins, polyamides, polycarbonates, polystyrenes, styrene-(meth)acrylic acid ester copolymers, polyacrylonitriles, polypropylenes, polyethylenes, fluororesins, polyurethanes, epoxy resins, silicone resins, polyester resins, melamine resins, urea resins, phenol resins, methacrylic resins, acrylic resins, alkyd resins, vinyl resins or copolymers of these monomers, aliphatic or alicyclic hydrocarbon resins, aromatic petroleum resins, chlorinated paraffins and paraffin waxes. It goes without saying that two or more of these bonding resins may also be used in appropriate mixtures.

Furthermore, examples of natural or synthetic rubber substances that can be used include natural rubber, chlorinated rubbers, cyclized rubbers, polyisobutylene rubbers, ethylene-propylene rubbers, ethylene-propylene-diene rubbers, polybutadiene rubbers, butyl rubbers, styrene-butadiene rubbers, acrylonitrile-butadiene rubbers, chloroprene rubbers, silicone rubbers, fluoro-rubbers and chlorohydrine rubbers, etc.

Furthermore, a bonding resin which has thermal bonding properties is desirable as the [above-mentioned] bonding resin; in this case, the use of styrene resins such as polystyrenes or styrene-(meth)acrylic acid ester copolymer, etc., polyester resins or epoxy resins is advantageous.

In addition to the above-mentioned components, various types of plasticizers, resistance adjusting agents and charge controlling agents may also be added as necessary to the toner of the present invention for the purpose of adjusting the thermal characteristics, electrical characteristics or physical characteristics, etc., of the toner.

Examples of plasticizers that can be used include dibutyl phthalate and dioctyl phthalate, etc., examples of resistance adjusting agents that can be used include tin oxide, lead oxide and antimony oxide, etc., and examples of charge controlling agents that can be used include quaternary ammonium salts, pyridinium salts and metal-containing dyes, etc.

Furthermore, in the present invention, the fluidity of the toner can be improved by adding a fine powder of $TiO_2$, $Al_2O_3$ or $SiO_2$, etc., to the toner particles, and deterioration of the photosensitive body can be prevented by adding zinc stearate or phthalic acid, etc., to the toner particles, following the manufacture of the toner particles. In the case of fine powders of $TiO_2$, $Al_2O_3$ or $SiO_2$, etc., the combined use of a fine powder with a mean particle size of 0.02 μm or less and a fine powder with a mean particle size of 0.03 to 1 μm makes it possible to obtain good images over a long period of time when more continuous printing is performed.

The toner of the present invention does not depend on a specified manufacturing method; this toner can be obtained using extremely common manufacturing methods. For example, the toner that is the object of the present invention can be obtained by mixing the above-mentioned components using a kneading means such as an extruder, two-roll machine, three-roll machine or hot kneader, etc., cooling the mixture, pulverizing the mixture by means of a pulverizer such as a jet mill, etc., and classifying the pulverized mixture by means of an air draft force classifier. Furthermore, it is desirable that the [mean] particle size of the toner of the present invention be 1 to 15 μm.

In manufacturing the toner, it is also possible to use a method in which a master batch with a high pigment concentration is prepared beforehand using a portion of the bonding resin that is used in the manufacture of the toner and a β-type copper phthalocyanine pigment which has a BET specific surface area of 90 $m^2/g$ or greater, after which a toner with a specified pigment concentration is prepared by mixing this master batch with the remainder of the bonding resin used in the preparation of the toner, so that the master batch is diluted.

Specifically, the toner that is the object of the present invention can also be obtained by converting an aqueous slurry (following pigment formation) or a wet cake (following washing with hot water) into a master batch by the flushing method described in Japanese Patent Application Kokoku No. S61-23828, then diluting and mixing this master batch with the toner resin, cooling this mixture, pulverizing the mixture with a pulverizer such as a jet mill, and classifying the pulverized mixture using an air draft force classifier.

For example, the carrier used in the present invention may consist of powdered iron, powdered nickel, powdered ferrites, glass beads or a carrier formed by using theses substances as a core material, and coating the surface of this core material with a styrene-acrylic acid ester copolymer, styrene-methacrylic acid ester copolymer, acrylic acid ester polymer, methacrylic acid ester polymer, silicone resin, polyamide resin, ionomer resin, polyphenylene sulfide resin or fluororesin, etc., or with a mixture of such resins. It is desirable that the particle size of this carrier be in the range of 50 to 300 μm.

The toner of the present invention may be used as a non-magnetic one-component color toner (non-magnetic one-component developing color toner) which does not contain any magnetic material in the electrostatic charge developing toner, or as a two-component color toner (two-component developing color toner) which is mixed with a carrier.

A two-component developing color toner can be obtained by pulverizing and mixing the above-mentioned carrier particles and the electrostatic charge developing toner of the present invention by means of a rotary-type mixture with a horizontal cylindrical or V-shaped vessel.

Furthermore, in order to obtain an appropriate image density, the mixture ratio of the carrier and the electrostatic charge developing toner is ordinarily in the range of 2 to 20 parts by weight of electrostatic charge developing toner per 100 parts by weight of carrier; however, this ratio is preferably in the range of 3 to 6 parts by weight [of toner per 100 parts by weight of carrier].

The toner of the present invention obtained as described above is used to form images on a recording medium. Examples of recording media that can be used include paper, synthetic resin films and metal foils, etc.

Next, the present invention will be described in detail in terms of examples of manufacture, working examples and comparative examples. Furthermore, all "parts" and "%" are based on weight.

EXAMPLE OF MANUFACTURE 1

1 part of a β-type copper phthalocyanine blue crude (mean particle size of primary particles: 2 μm, BET specific surface area according to nitrogen adsorption method: 8 $m^2/g$), 10 parts of pulverized sodium chloride, 1 part of diethylene glycol and 0.05 parts of a copper phthalocyanine phthalimide methyl derivative were placed in a twin-arm-type kneader, and these ingredients were kneaded for 10 hours at 85° C. Following kneading, the mixture was removed into 100 parts by weight of a 1% aqueous solution of hydrochloric acid at 80° C., and was agitated for 1 hour. The mixture was then filtered, washed with hot water, dried and pulverized to produce a β-type copper phthalocyanine pigment (a).

In regard to the BET specific surface area of the pigment (a) thus obtained as determined by the nitrogen adsorption method, the specific surface area measured using a Microsorb 4232II manufactured by MICRO DATA CO. (sample pretreatment: 20 minutes at a temperature of 120° C, amount of sample collected: 0.2 g, method used to measure amount of adsorption: one-point method, nitrogen partial pressure: 0.3) was 130 $m^2/g$. Furthermore, the result corrected using an MO-206-11 of the NIST (National Institute of Standards and Technology) (specific surface area 110±7 $m^2/g$) was 112.34 $m^2/g$.

Furthermore, the mean particle size of the primary particles and the longitudinal-lateral aspect ratio of the primary particles were determined from the results of measurements performed using a transmission electron microscope JEM-2010 (manufactured by JEOL Ltd). The amount of oil adsorption was determined according to the above-mentioned JIS. The mean particle size of the powdered pigment as a whole was determined using a Microtrack Particle Size Distribution Meter 9220FRA Dry Model (manufactured by Nikkiso Co., Ltd.). These measurement results are summarized in Table 1.

TABLE 1

| Item | Measured Value |
|---|---|
| Specific surface area | 130 $m^2/g$ |
| Mean particle size of primary particles | 0.02 μm |
| Aspect ratio of primary particles | 2 |
| Amount of oil adsorption | 57 ml/100 g |
| Overall mean particle size | 16 μm |

EXAMPLE OF MANUFACTURE 2

A β-type copper phthalocyanine blue crude (mean particle size of primary particles: 2 μm, BET specific surface area according to nitrogen adsorption method: 8 $m^2/g$) was subjected to dry pulverization using an attritor mill device at an output power density of 0.4 kW per 1 L of pulverization space, thus producing a semi-crude (mixture of α type and β type) in which the mean particle size of the primary particles was 0.002 μm.

Furthermore, the attritor mill device used here is an attritor mill device [i] which consists of a cylindrical pulverization vessel with a vertical center line which is used to hold the powder that is to be pulverized, a rotating shaft which is installed along this center line, and an agitator which is fastened to this rotating shaft and which has two or more pairs of arms that respectively extend symmetrically outward toward the side walls of the pulverization vessel, and [ii] which is filled with steel balls as a pulverization medium.

1 part of this semi-crude, 10 parts of pulverized sodium chloride, 1 part of diethylene glycol and 0.10 parts of a copper phthalocyanine N-(dimethylaminopropyl)sulfonic acid amide derivative were placed in a twin-arm kneader, and these ingredients were kneaded for 7 hours at 60° C. After kneading, the mixture was removed into 100 parts by weight of a 1% aqueous solution of hydrochloric acid at 80° C., and was agitated for 1 hour. The mixture was then filtered, washed with hot water, dried and pulverized to produce a β-type copper phthalocyanine pigment (b).

The specific surface area of the pigment (b) thus obtained as measured by the above-mentioned device was 140 $m^2/g$, and the mean particle size of the primary particles as measured by the above-mentioned device was 0.01 μm. The longitudinal-lateral aspect ratio of the primary particles, the amount of oil adsorption and the mean particle size of the powdered pigment as a whole were similarly determined. These measurement results are summarized in Table 2.

TABLE 2

| Item | Measured Value |
|---|---|
| Specific surface area | 140 $m^2/g$ |
| Mean particle size of primary particles | 0.01 μm |
| Aspect ratio of primary particles | 1.5 |
| Amount of oil adsorption | 60 ml/100 g |
| Overall mean particle size | 14 μm |

EXAMPLE OF MANUFACTURE 3

1 part of the β-type copper phthalocyanine blue crude used in Example of Manufacture 1, 3 parts by weight of pulverized sodium chloride and 1 part by weight of diethylene glycol were placed in a twin-arm kneader, and these ingredients were kneaded for 3 hours at 120° C. to 130° C. Following kneading, the mixture was removed into 100 parts by weight of a 1% aqueous solution of hydrochloric acid at 80° C., and was agitated for 1 hour. The mixture was then filtered, washed with hot water, dried and pulverized to produce a β-type copper phthalocyanine pigment (c).

The specific surface area of the pigment (c) thus obtained as measured by the above-mentioned device was 40 $m^2/g$, and the mean particle size of the primary particles as measured by the above-mentioned device was 0.08 μm. The longitudinal-lateral aspect ratio of the primary particles, the amount of oil adsorption and the mean particle size of the powdered pigment as a whole were similarly determined. These measurement results are summarized in Table 3.

TABLE 3

| Item | Measured Value |
|---|---|
| Specific surface area | 40 $m^2/g$ |
| Mean particle size of primary particles | 0.08 μm |
| Aspect ratio of primary particles | 3.5 |
| Amount of oil adsorption | 35 ml/100 g |
| Overall mean particle size | 14 μm |

WORKING EXAMPLE 1

100 parts of a styrene-acrylic acid copolymer (Hymer SBM 100, manufactured by Sanyo Chemical Industries, Ltd.) and 5 parts of the β-type copper phthalocyanine pigment (a) manufactured in Example of Manufacture 1 were kneaded by means of an extruder, and this mixture was them pulverized and classified to produce a toner with a mean particle size of 10 μm. Next, 1.0 parts of hydrophobic silica was mixed with 100 parts of this toner.

When developing was performed by means of an ordinary dry copying machine (RICOPY FT3010, manufactured by Ricoh Co., Ltd., same below) using a ferrite carrier and this toner containing hydrophobic silica, vivid cyan images with no fogging of the grain were obtained at even 5000 copies. Furthermore, when developing was performed on an OHP sheet and the transparency was evaluated, the transmissivity at 470 nm was good, showing a value of 90%.

Next, when developing was performed in combination with a yellow toner containing hydrophobic silica using C. I. Pigment Yellow 17, a vivid green color was reproduced.

Furthermore, when developing was performed in combination with a magenta toner containing hydrophobic silica using C. I. Pigment Red 122, a vivid violet color was obtained.

Furthermore, when developing was performed in combination with a yellow toner containing hydrophobic silica using C. I. Pigment Yellow 17 and a magenta toner containing hydrophobic silica using C. I. Pigment Red 122, the portions corresponding to black in the original were reproduced with a pure black color.

WORKING EXAMPLE 2

A toner containing hydrophobic silica with a mean particle size of 10 μm was obtained in the same manner as in Working Example 1, except that the β-type copper phthalocyanine pigment (b) manufactured in Example of Manufacture 2 was used instead of the β-type copper phthalocyanine pigment (a) manufactured in Example of Manufacture 1.

When developing was performed by means of an ordinary dry copying machine (RICOPY FT3010, manufactured by Ricoh Co., Ltd., same below) using a ferrite carrier and this toner containing hydrophobic silica, vivid cyan images with no fogging of the grain were obtained at even 5000 copies. Furthermore, when developing was performed on an OHP sheet and the transparency was evaluated, the transmissivity at 470 nm was good, showing a value of 92%.

Next, when developing was performed in combination with a yellow toner containing hydrophobic silica using C. I. Pigment Yellow 17, a vivid green color was reproduced.

Furthermore, when developing was performed in combination with a magenta toner containing hydrophobic silica using C. I. Pigment Red 122, a vivid violet color was obtained.

Furthermore, when developing was performed in combination with a yellow toner containing hydrophobic silica using C. I. Pigment Yellow 17 and a magenta toner containing hydrophobic silica using C. I. Pigment Red 122, the portions corresponding to black in the original were reproduced with a pure black color.

COMPARATIVE EXAMPLE 1

A toner containing hydrophobic silica with a mean particle size of 10 μm was obtained in the same manner as in Working Example 1, except that the β-type copper phthalocyanine pigment (c) manufactured in Example of Manufacture 3 was used instead of the β-type copper phthalocyanine pigment (a) manufactured in Example of Manufacture 1.

When developing was performed by means of an ordinary dry copying machine (RICOPY FT3010, manufactured by Ricoh Co., Ltd., same below) using a ferrite carrier and this toner containing hydrophobic silica, cyan images as vivid as those obtained in Working Example 1 could not be obtained. Furthermore, when developing was performed on an OHP sheet and the transparency was evaluated, the transmissivity at 470 nm was poor, showing a value of 86%.

Furthermore, respective developing processes were performed in combination with a yellow toner containing hydrophobic silica using C. I. Pigment Yellow 17, in combination with a magenta toner containing hydrophobic silica using C. I. Pigment Red 122, and in combination with a yellow toner containing hydrophobic silica using C. I. Pigment Yellow 17 and a magenta toner containing hydrophobic silica using C. I. Pigment Red 122; in all of these cases, however, the green, violet and black colors obtained were not vivid, so that the reproducibility was poor.

In the electrostatic charge developing toner of the present invention, the BET specific surface area of the β-type copper phthalocyanine pigment that is used is in a specified range, so that the toner is extremely superior in terms of transparency. As a result, the present invention has the following conspicuous effects: specifically, vivid cyan images can be obtained, and in cases where the toner of the present invention is used in combination with yellow toners or magenta toners, the [resulting images] are superior in terms of color reproducibility.

Furthermore, if the longitudinal-lateral aspect ratio of the pigment particles is 1 to 3, the hue is greenish, and the color reproducibility is further improved.

Furthermore, a toner using the above-mentioned β-type copper phthalocyanine pigment which further contains a phthalocyanine pigment derivative also shows a good charging stability.

What is claimed is:

1. An electrostatic charge developing toner which is characterized by the fact that in an electrostatic charge developing toner which contains a bonding resin and a coloring agent as essential components, a β-type copper phthalocyanine pigment which has a BET specific surface area of greater than 90 $m_2/g$ and a longitudinal-lateral aspect ratio of 1 to 3, and which further contains a phthalocyanine pigment derivative expressed by the following general formula (I) or (II)

a) Chemical Formula 1: $P—(Y)_n$ (I)

b) Chemical Formula 2: $P—(A\text{-}Z)_n$ (II)

wherein P indicates a residue formed by removing the hydrogen of n phthalocyanine rings which either have a central metal or do not have a central metal, Y indicates a primary to tertiary amino group, carboxylic acid group, sulfonic acid group or salt of the same with a base or metal, A indicates an alkylene group with 1 to 3 carbon atoms, $—CO_2—$, $—SO_2—$ or $—SO_2NH(CH_2)_m—$, Z indicates a residue formed by removing at least one hydrogen atom on the nitrogen atom of a primary or secondary amino group, or a residue formed by removing at least one hydrogen atom on the nitrogen atom of a phthalimide group; m is 1 to 4; and n is 1 to 4.

2. The electrostatic charge developing toner claimed in claim 1, in which the amount of the phthalocyanine pigment derivative is 0.01 to 0.3 parts by weight per 1 part by weight of the beta-type phthalocyanine pigment.

3. An electrostatic charge developing toner which is characterized by the fact that in an electrostatic charge developing toner which contains a bonding resin and a coloring agent as essential components, a β-type copper phthalocyanine pigment which has a BET specific surface area of at least 110 $m^2/g$ and a longitudinal-lateral aspect ratio of 1 to 3, and which further contains 0.01 to 0.3 part per one part of the β-type phthalocyanine pigment of a phthalocyanine pigment derivative expressed by the following general formula (I) or (II)

a) Chemical Formula 1: $P—(Y)_n$ (I)

b) Chemical Formula 2: $P—(A\text{-}Z)_n$ (II)

wherein P indicates a residue formed by removing the hydrogen of n phthalocyanine rings which either have a central metal or do not have a central metal, Y indicates a primary to tertiary amino group, carboxylic acid group, sulfonic acid group or salt of the same with a base or metal, A indicates an alkylene group with 1 to 3 carbon atoms, $—CO_2—$, $—SO_2—$ or $—SO_2NH(CH_2)_m—$, Z indicates a residue formed by removing at least one hydrogen atom on the nitrogen atom of a primary or secondary amino group, or a residue formed by removing at least one hydrogen atom on the nitrogen atom of a phthalimide group; m is 1 to 4; and n is 1 to 4.

4. The electrostatic charge developing toner as claimed in claim 3 in which the amount of beta-type copper phthalocyanine pigment is 0.5-25 pph of the bonding resin.

5. The electrostatic charge developing toner as claimed in claim 4 in which the β-type phthalocyanine pigment has an average particle size of 0.01 and 0.6 μm.

6. An electrostatic charge developing toner which is characterized by the fact that in an electrostatic charge developing toner which contains a bonding resin and a coloring agent as essential components, a β-type copper phthalocyanine pigment which has a BET specific surface area of at least 110 $m^2/g$ and a longitudinal-lateral aspect ratio of 1 to 3, and which further contains a phthalocyanine pigment derivative expressed by the following general formula (I) or (II)

a) Chemical Formula 1: $P—(Y)_n$ (I)

b) Chemical Formula 2: $P—(A\text{-}Z)_n$ (II)

wherein P indicates a residue formed by removing the hydrogen of n phthalocyanine rings which either have a central metal or do not have a central metal, Y indicates a primary to tertiary amino group, carboxylic acid group, sulfonic acid group or salt of the same with a base or metal, A indicates an alkylene group with 1 to 3 carbon atoms, $—CO_2—$, $—SO_2—$ or $—SO_2NH(CH_2)_m—$, Z indicates a residue formed by removing at least one hydrogen atom on the nitrogen atom of a primary or secondary amino group, or a residue formed by removing at least one hydrogen atom on the nitrogen atom of a phthalimide group; m is 1 to 4; and n is 1 to 4.

7. The electrostatic charge developing toner as claimed in claim 6 in which the amount of beta-type copper phthalocyanine pigment is 0.5-25 pph of the bonding resin, and the beta-type copper phthalocyanine pigment has a BET specific surface area of 110-150 $m^2/g$.

8. The electrostatic charge developing toner as claimed in claim 7 in which the β-type phthalocyanine pigment has an average particle size of 0.01 and 0.6 μm.

* * * * *